US009226371B2

(12) United States Patent
Mohan

(10) Patent No.: US 9,226,371 B2
(45) Date of Patent: Dec. 29, 2015

(54) USER CONTROL OF AN ENVIRONMENTAL PARAMETER OF A STRUCTURE

(75) Inventor: Tanuj Mohan, Mountain View, CA (US)

(73) Assignee: enLighted, Inc., Sunnyvale, CA (US)

( * ) Notice: Subject to any disclaimer, the term of this patent is extended or adjusted under 35 U.S.C. 154(b) by 747 days.

(21) Appl. No.: 13/533,504

(22) Filed: Jun. 26, 2012

(65) Prior Publication Data

US 2013/0342111 A1 Dec. 26, 2013

(51) Int. Cl.

*H05B 37/02* (2006.01)
*H05B 39/04* (2006.01)
*H05B 41/36* (2006.01)

(52) U.S. Cl.

CPC ..... *H05B 37/0272* (2013.01); *H05B 37/0254* (2013.01)

(58) Field of Classification Search

CPC ..... H05B 37/02
USPC ..... 315/152
See application file for complete search history.

(56) References Cited

U.S. PATENT DOCUMENTS

| | | | |
|---|---|---|---|
| 5,101,141 | A | 3/1992 | Warner et al. |
| 5,179,324 | A | 1/1993 | Audbert |
| 5,191,265 | A | 3/1993 | D'Aleo et al. |
| 5,283,516 | A | 2/1994 | Lohoff |
| 5,812,422 | A | 9/1998 | Lyons |
| 6,057,654 | A | 5/2000 | Cousy et al. |
| 6,188,181 | B1 | 2/2001 | Sinha et al. |
| 6,342,994 | B1 | 1/2002 | Cousy et al. |
| 6,548,967 | B1 | 4/2003 | Dowling et al. |
| 7,309,985 | B2 | 12/2007 | Eggers et al. |
| 7,348,736 | B2 | 3/2008 | Piepgras et al. |
| 7,382,271 | B2 | 6/2008 | McFarland |
| 7,437,596 | B2 | 10/2008 | McFarland |
| 7,550,931 | B2 | 6/2009 | Lys et al. |
| 7,566,137 | B2 | 7/2009 | Veskovic |
| 7,623,042 | B2 | 11/2009 | Huizenga |
| 7,792,956 | B2 | 9/2010 | Choong et al. |
| 7,925,384 | B2 | 4/2011 | Huizenga et al. |
| 2004/0002792 | A1 | 1/2004 | Hoffknecht |
| 2005/0169643 | A1 | 8/2005 | Franklin et al. |
| 2006/0275040 | A1 | 12/2006 | Franklin |
| 2007/0057807 | A1 | 3/2007 | Walters et al. |
| 2007/0061050 | A1 | 3/2007 | Hoffknecht |
| 2007/0086128 | A1 | 4/2007 | Lane et al. |
| 2007/0215794 | A1 | 9/2007 | Cernasov et al. |
| 2008/0185597 | A1 | 8/2008 | Wu |
| 2008/0244104 | A1 | 10/2008 | Clemente |
| 2008/0265796 | A1 | 10/2008 | Null |
| 2009/0026966 | A1 | 1/2009 | Budde et al. |
| 2009/0179596 | A1 | 7/2009 | Willaert et al. |
| 2009/0195161 | A1 | 8/2009 | Lane et al. |

(Continued)

*Primary Examiner* — Sibin Chen
*Assistant Examiner* — Metasebia Retebo
(74) *Attorney, Agent, or Firm* — Brian R. Short

(57) ABSTRACT

An apparatuses, methods and systems for providing user control of an environmental parameter of a structure are disclosed. One method includes establishing a direct communication link between a user device and a fixture located within the structure, receiving, by a central controller, information of the user device from the fixture through a first communication link, receiving, by the central controller, control information from the user device through a second communication link, and communicating, by the central controller, the control information to the fixture, wherein the fixture controls the environmental parameter based on the control information.

25 Claims, 7 Drawing Sheets

(56) References Cited

U.S. PATENT DOCUMENTS

| | | | | |
|---|---|---|---|---|
| 2009/0278479 | A1* | 11/2009 | Platner et al. | 315/312 |
| 2010/0034386 | A1 | 2/2010 | Choong et al. | |
| 2010/0135186 | A1 | 6/2010 | Choong et al. | |
| 2010/0264846 | A1 | 10/2010 | Chemel et al. | |
| 2010/0270933 | A1 | 10/2010 | Chemel et al. | |
| 2010/0295482 | A1 | 11/2010 | Chemel et al. | |
| 2010/0301777 | A1 | 12/2010 | Kraemer | |
| 2011/0031897 | A1 | 2/2011 | Henig et al. | |

* cited by examiner

USER CONTROL OF AN ENVIRONMENTAL PARAMETER OF A STRUCTURE

FIELD OF THE EMBODIMENTS

The described embodiments relate generally to building environmental control. More particularly, the described embodiments relate to user control of an environmental parameter of a structure.

BACKGROUND

Lighting control systems automate the operation of lighting within a building or residence based upon, for example, preset time schedules and/or occupancy and/or daylight sensing. The Lighting systems typically employ occupancy sensors and/or daylight sensors to determine which lighting devices to activate, deactivate, or adjust the light level of, and when to do so. Occupancy sensors typically sense the presence of one or more persons within a defined area and generate signals indicative of that presence. Daylight sensors typically sense the amount of daylight present within a defined area and generate signals indicative of that amount. Typically, lighting systems receive the sensor signals at a central lighting controller.

The lighting systems are advantageous because they typically reduce energy costs by automatically lowering light levels or turning off devices and appliances when not needed, and they can allow all devices in the system to be controlled from one location.

The above-described lighting systems, however, do not provide specific user control over the lighting devices. Generally, user control of lighting within buildings is limited to physically installed switches. Implementing the user control without physical switches, that is with logical switches that are implemented in software, is difficult because it is a nightmare to associate occupant users with specific lights or lighting fixtures in a logical fashion (that is, on, for example, a web browser or a mobile device). It is very difficult to provide a logical switch (in software) that can determine that the user is physical proximate to one of the lights or light fixtures, and to also authorize the user to have control over the light or light fixture.

It is desirable to have a method, system and apparatus for user control of an environmental parameter of a structure.

SUMMARY

One embodiment includes a method of providing user control of an environmental parameter of a structure. The method includes establishing a direct communication link between a user device and a fixture located within the structure, receiving, by a central controller, information of the user device from the fixture through a first communication link, receiving, by the central controller, control information from the user device through a second communication link, and communicating, by the central controller, the control information to the fixture, wherein the fixture controls the environmental parameter based on the control information.

Another embodiment includes a system that provides user control of lighting of a structure. The system includes a lighting fixture operative to establish a direct communication link between a user device and the lighting fixture, wherein the lighting fixture is located within the structure. The system further includes a central controller operative to receive information of the user device from the fixture through a first communication link, receive control information from the user device through a second communication link, and communicate the control information to the fixture, wherein the fixture controls the lighting based on the control information.

Another embodiment includes an intelligent lighting fixture. The intelligent lighting fixture includes a light, and a sensor, wherein the sensor operative to receive stimulus from a mobile device through a direct communication link. The intelligent lighting fixture further includes a communication module, wherein the communication module is operative to communicate information of the user device to a central controller through a first communication link, receive control information from the central controller through the first communication link, wherein the control information is received by the central controller from the user device through a second communication link, and control an intensity of the light based on the received control information.

Another embodiment includes a method of providing user control of an environmental parameter of a structure. The method includes establishing a direct communication link between a user device and a fixture located within the structure, the fixture identifying itself by a first communication link to the user device, and the user device using this identification to send control information to the fixture using the first communication link. This embodiment includes proximity based authorization.

Another embodiment includes method of providing user control of an environmental parameter of a structure. The method includes a user requesting control of one or more fixtures located within the structure, a central controller (backend server) receiving the user request (through a cellular or WiFi connection), accessing an electronic calendar (located at the central controller or remotely) to locate the fixture according to the electronic calendar, and providing the user with control information associated with the fixture, and the user selecting a control option for the fixture settings, and communicating selected control option back to selected fixture.

Other aspects and advantages of the described embodiments will become apparent from the following detailed description, taken in conjunction with the accompanying drawings, illustrating by way of example the principles of the described embodiments.

DETAILED DESCRIPTION

Figure 1:
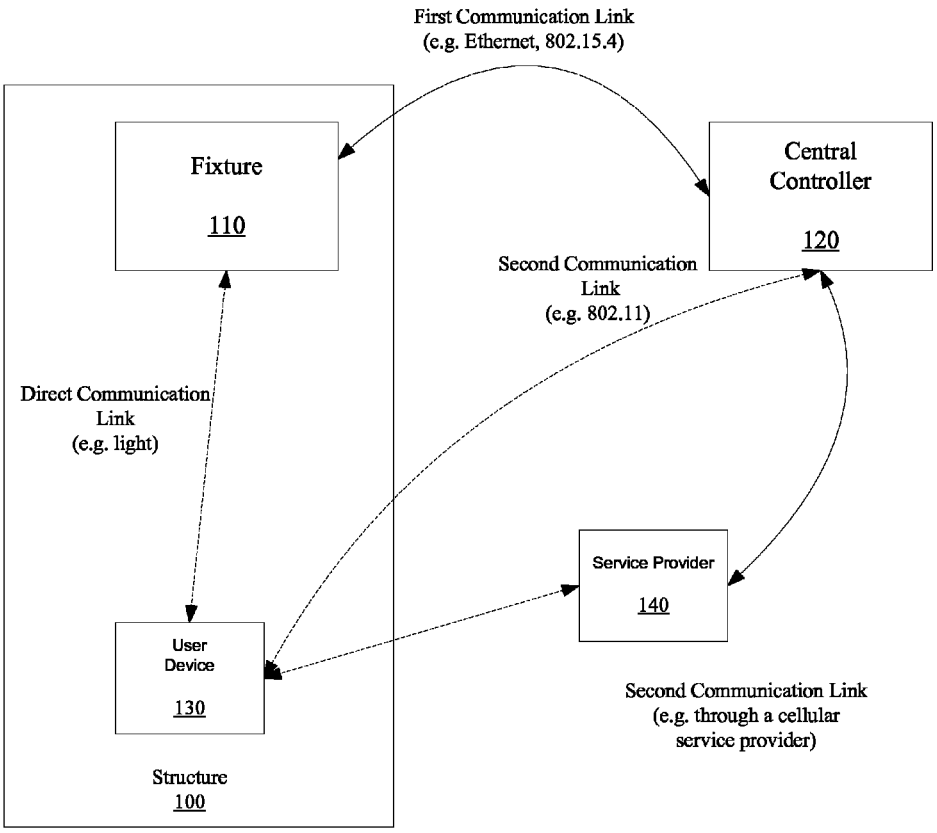
FIG. 1 shows a system that provides user control of an environmental parameter of a structure, according to an embodiment.

As shown in the drawings, the described embodiments are embodied in an apparatuses, methods, and systems for providing user control of an environmental parameter of a structure, according to an embodiment.

At least some of the disclosed embodiments include two steps in setting up control. The first step includes binding or associating the user control (e.g. remote switch) with the environmental fixture (e.g. light fixture). For at least some embodiment, strobing the fixture is used to determine physical binding. However, other embodiment include, for example, looking up an electronic calendar or user schedule, to establish or determine binding. For example, based on a user's electronic schedule, binding with, for example, a fixture within a conference room or any other room, is established by the user's electronic schedule indicating the presence of the user. The second step includes authorizing the user. That is, the user is authorized to control the environmental parameter associated with the fixture (such as, lighting). Authorization can occur at many levels. For example, authorization can be established based on, for example, physical presence of the user, or through a login procedure using electronic management or an active directory.

FIG. 1 shows a system that provides user control of an environmental parameter of a structure, according to an embodiment. A fixture 110 is located within a structure 100. The structure can be a building, parking structure or any other structure that one may want to control lighting, temperature, humidity, security or other environment parameters.

As shown, a user device 130 typically located within the structure, can control one or more of the environmental parameters. The user device 130 can be any type of computing device that includes a controller and a communication interface. The user device 130 establishes communication with the fixture 110, through, for example, a direct communication link. The link is typically a line-of-sight link, and can be established by the user device pulsing a light signal which a light sensor of the fixture 110 sensed. For example, this strobing can be done using the camera flash on a mobile device (e.g. cell-phone). This direct fink, however, can be established through any type of stimulus. For example, the direct link can be established through motion of a user of the user device 130 that the fixture sensed. Alternatively, or additionally, the direct link can include any type of wireless communication. For an embodiment, the direct link between the user device 110 merely establishes communication between the user device 130 and the fixture 110 so that each is aware of the other. For another embodiment, the direct link between the user device 110 and the fixture 110 provides a means for communicating from the user device 130 to the fixture 110, or communication between (back and forth) the user device 130 and the fixture 110.

Upon establishing the direct link between the user device 130 and the fixture 110, the fixture establishes a first communication link to a central controller 120. The fixture 110 indicates to the controller 120 that a direct connection has been established between the fixture 110 and the user device 130. The first communication link can include one or more communication links. That is, the first communication link can include multiple hops of communication links (wired and/or wireless).

Further, the user device 130 establishes a second communication link to the central controller 120. Generally, the user device 130 communicates control information to the central controller 120 through the second communication link. For example, if the fixture 110 controls lighting of a conference room in which both the fixture 110 and the user device 130 are located, the control information can includes lighting and/or temperature requests of the user of the user device 130. The central controller 120 can then honor the request of the user by appropriately controlling the fixture 110 through the first communications link.

Two examples of the second communication link are shown. A first includes a direct link through the user device 130 and the central controller. This could be implemented, for example, by a (802.11) connection between the user device 130 and the central controller 120. The second communication link could alternatively be implemented through a cellular service provider. That is, the user device can establish a wireless connection with a cell tower of a cellular service provider. The service provider can then provide a connection to the central controller 120.

As shown and described, the central controller 120 does not have to know exactly where the user device 130 is located. The direct communication link between the user device 130 and the fixture indicates that the user device is proximate to the fixture 110, and that the user of the user device is trying to control a parameter of the fixture 110. The direct communication link can be a very simple link because the control information of the user device is being delivered to the central controller 120 through an alternate (the second) communication link.

Figure 2:
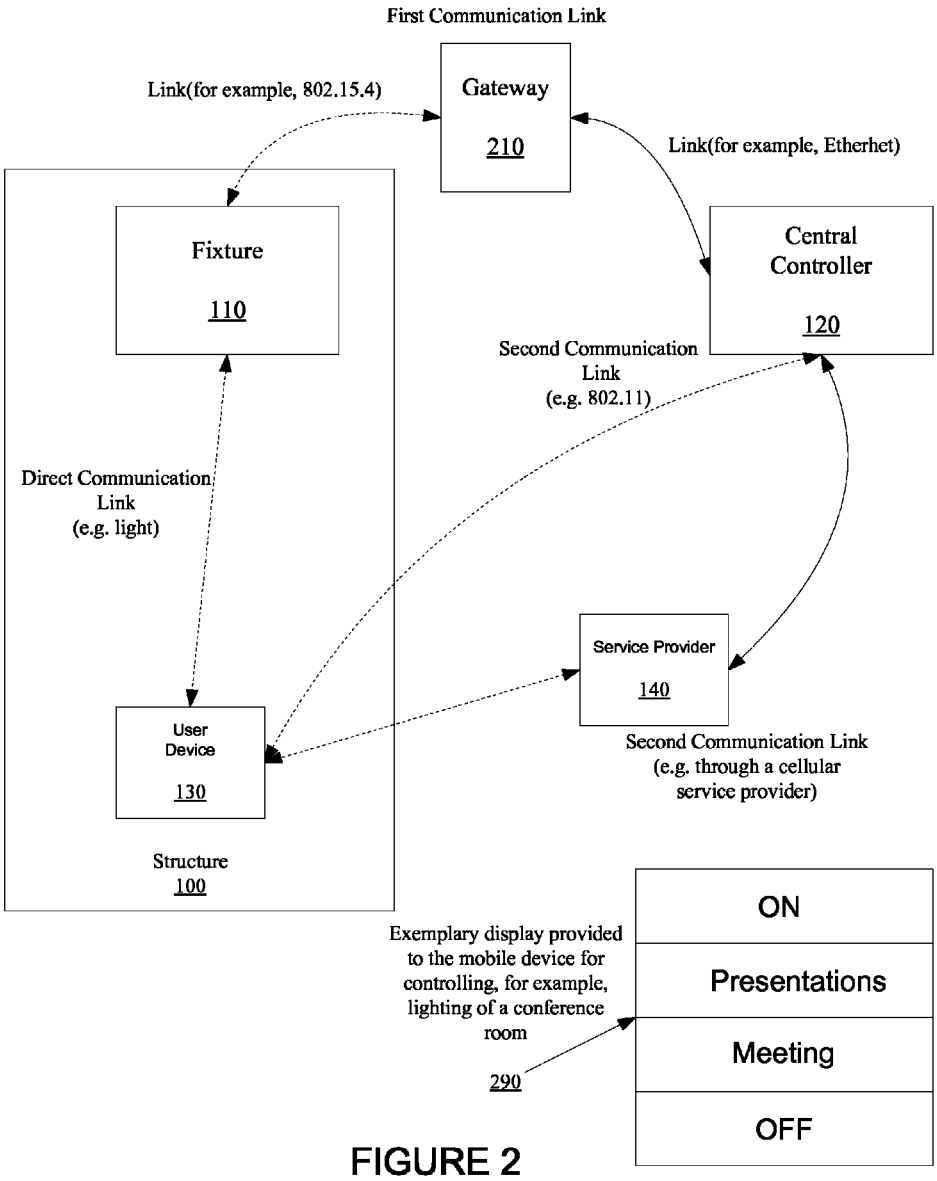
FIG. 2 shows a system that provides user control of an environmental parameter of a structure, according to another embodiment.

FIG. 2 shows a system that provides user control of an environmental parameter of a structure, according to another embodiment. This embodiment further includes a gateway 210. An embodiment of the gateway 210 manages the connections, interfaces and controls of multiple fixtures.

As shown, the first communication link is established between the fixture 110 and the central controller 120 through a link (for example, a Zigbee® 802.15.4 wireless link) between the fixture 110 and the gateway 210, and a link (for example, an Ethernet® wired link) between the gateway 210 and the central controller 120.

Additionally, as shown, upon the central controller 120 receiving a control request from the user device 130, an embodiment includes the central controller providing the user device 130 with a display that includes, for example, various control parameter information. As shown, one example includes a display 290 as shown on a screen of the user device 130 that provides the user of the user device 130 various control information and selections. The example shown includes a display that provides light on and off control, a presentations selection that indicates that the user is presenting within a conference room of the fixture 110, and that the conference room lighting is to be selected to be suitable for such presentations, a meeting selection that indicates the user is indicating that the conference room is to be used for a meeting, and that the lighting of the conference room needs to be appropriately set.

Figure 3:
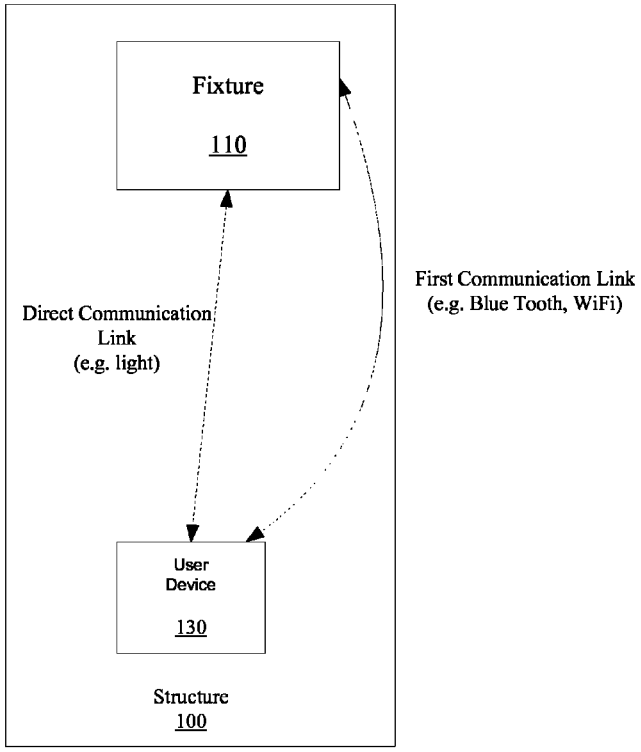
FIG. 3 shows a system that provides user control of an environmental parameter of a structure, according to another embodiment.

FIG. 3 shows a system that provides user control of an environmental parameter of a structure 100, according to another embodiment. For this embodiment, the user device 130 establishes a direct communication link between the user device 130 and a fixture 110 located within the structure 100. The fixture 110 then identifies itself to the user device 130 through a first communication link to the user device 130 by sending a broadcasts/multicast message. The user device 130 then uses this identification to send control information to the fixture 110 using the first communication link. By learning the fixture address from the broadcast/multicast message the user device 130 is able to send a unicast message to control the fixture 110. The direct link is different than the first communication link.

Figure 4:
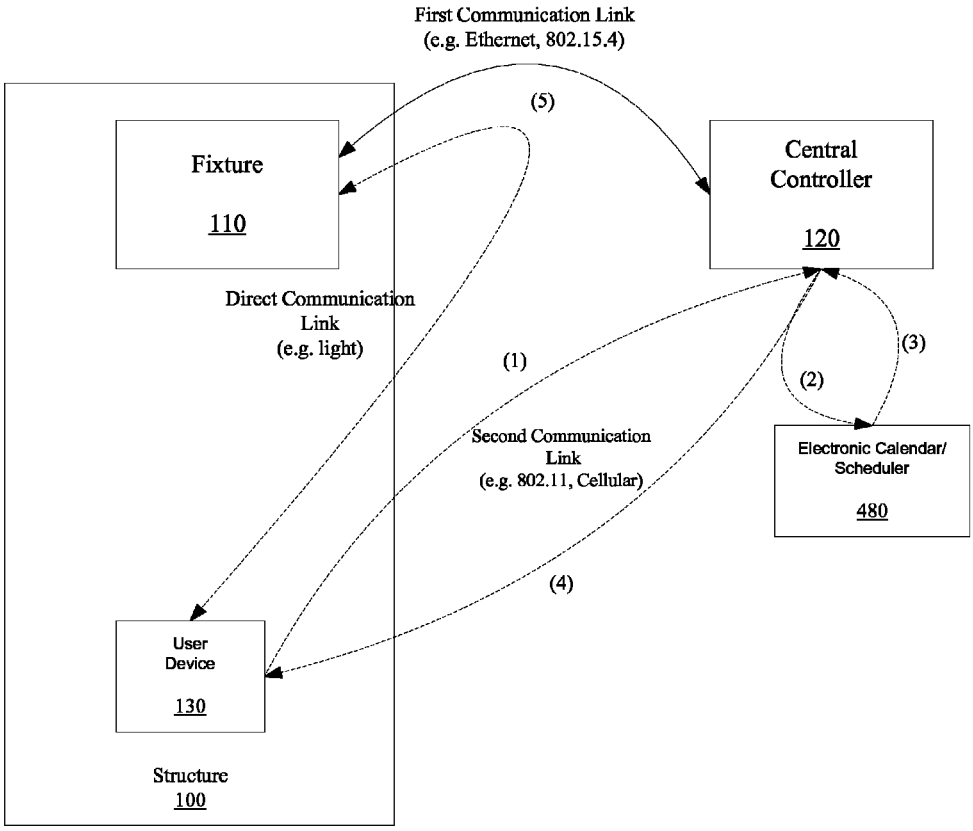
FIG. 4 shows a system that provides user control of an environmental parameter of a structure, according to another embodiment.

FIG. 4 shows a system that provides user control of an environmental parameter of a structure 100, according to another embodiment. A sequence of operation is labeled (1)

through (6) for an example of an implementation of this embodiment. A first step (1) includes a user device 130 requesting control of one or more fixtures (such as fixture 110) located within the structure 100. A second step (2) includes a central controller 120 (backend server) receiving the user request (through a second link that is, for example, a cellular or WiFi connection). A third step (3) includes the central controller accessing an electronic calendar 480 (located at the central controller or remotely) to locate the fixture 110 according to the electronic calendar 480. A fourth step (4) includes the central controller 120 providing the user device 130 with control information associated with the fixture 110. This includes, for example, on/off, dim or preset scenes for an individual or group of fixtures. A fifth step (5) includes the user device selecting a control option (for example, on/off etc.) for the fixture 110, and communicating this back to selected fixture 110. The communication back to the fixture 110 can be a direct communication link (for example Bluetooth, WiFi etc.), or the communication link can be back through the central controller 120 (through, for example, the second link) and then back to the fixture 110 (through, for example, the first link). The electronic calendar 480 is a database that includes a scheduler/calendar of users and locations (rooms) and times in which the users are authorized to have control over one or more fixtures associated with a particular room or location within the structure.

Figure 5:
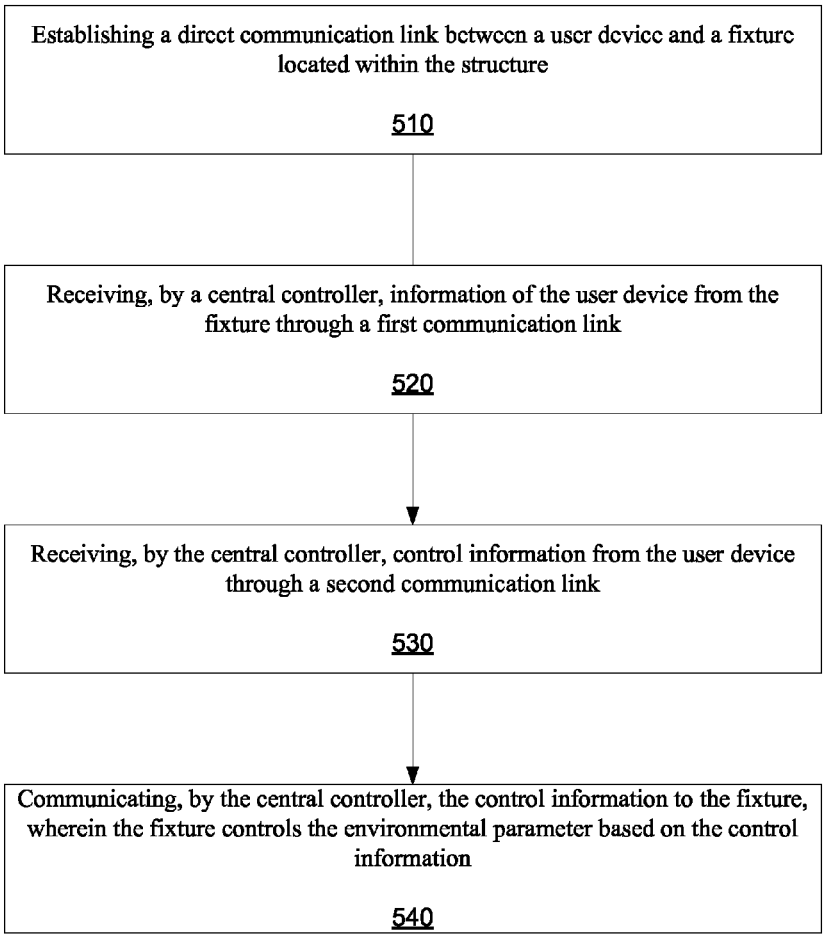
FIG. 5 is a flow chart that includes the steps of a method of providing user control of an environmental parameter of a structure.

FIG. 5 is a flow chart that includes the steps of a method of providing user control of an environmental parameter of a structure. A first step 510 includes establishing a direct communication link between a user device and a fixture located within the structure, A second step 520 includes receiving, by a central controller, information of the user device from the fixture through a first communication link. A third step 530 includes receiving, by the central controller, control information from the user device through a second communication link. A fourth step 540 includes communicating, by the central controller, the control information to the fixture, wherein the fixture controls the environmental parameter based on the control information.

For an embodiment, the central controller associates the user device with the fixture by correlating the receiving of information from the fixture through the first communication link with the receiving of the control information from the user device through the second communication link. For an embodiment, the correlation includes a timing correlation. That is, the central controller receives the information of the user through the first communication link within, for example, a time window of when the central controller receives the control information through the second communication link. An alternative embodiment includes the central controller receive some sort of identifier information of the user device through the first communication link, and therefore, does not have to correlate the timing of the first link communication and the second link communication.

It is possible that the central controller receives first and second communication link information within a small time window. For example, a large building may include many fixtures and many occupants. Therefore, multiple occupants may be requesting control over multiple fixtures. Accordingly, for an embodiment, if the central controller correlates information received from more than one fixture with the user device, then the controller provides the user device with a selection. That is, the correlation may end up associating two separate fixtures with a single user. It this situation, the central controller communicates back to the user device over the second communications link a selection between multiple possible fixtures. The user can then select the fixture that the user desires control. For another embodiment, if the central controller correlates information received from more than one fixture with the user device, then the central controller communicates this (that is, that more than one fixture has been correlated to) to the user device, allowing the user device to re-establishing the direct communication link between the user device and the fixture located within the structure, whereby the central controller again receives of the information of the user device from the fixture through the first communication link, thereby uniquely associating the user device with the fixture.

For an embodiment, establishing the direct communication link includes a sensor of the fixture receiving a stimulus directly from the user device. For an embodiment, the sensor is an ambient light sensor. For another embodiment, the sensor is a motion sensor. It is to be understood that alternate sensor can additionally or alternatively be used.

For an embodiment, the direct communication link includes a line-of-sight link between the user device and the fixture. Typically, the line-of-sight link establishes that the user and the user device are in fact proximate to the fixture. For an embodiment, the stimulus comprises emitted light. For an embodiment, the stimulus includes information allowing identification of the user device that emitted the stimulus.

For an embodiment, the user device completes a log-in procedure with the central controller. That is, for example, the user device can log-in with the central controller upon entering a building or structure that includes many of the described fixtures. Logging in with the central controller can be desirable, and provide for a better user-experience. For example, by previously logging in, a request for control by the user device can be honored much more quickly as the setup time for a connection (up to a couple of seconds for a secure wireless connection) can be been eliminated.

For an embodiment, the fixture is a member of a logical group of fixtures, and the central controller provides control of a plurality of fixtures within the logical group as determined by the control information received from the user device. For an each of the building fixtures of the logical group are operative to receive an input from a device, wherein the building fixture responds to the input if the input includes an identifier associating the input with the logical group. For this embodiment an external controller can interface with particular logical groups based on the unique identifier associated with the logical group. Associating the unique identifiers with logical groups provides for ease of scaling of the number of building fixtures. That is, for example, conventional centrally-controlled systems require either more messages or larger messages to control building fixtures, whereas including unique identifiers with logical groups provides for an efficient system in which the transmitted data doesn't grow or increase as the group grows. Additionally, the system is less reliant on and requires less use of any one communication channel, and therefore, the likelihood of failure due to communication channel use is less.

Figure 6:
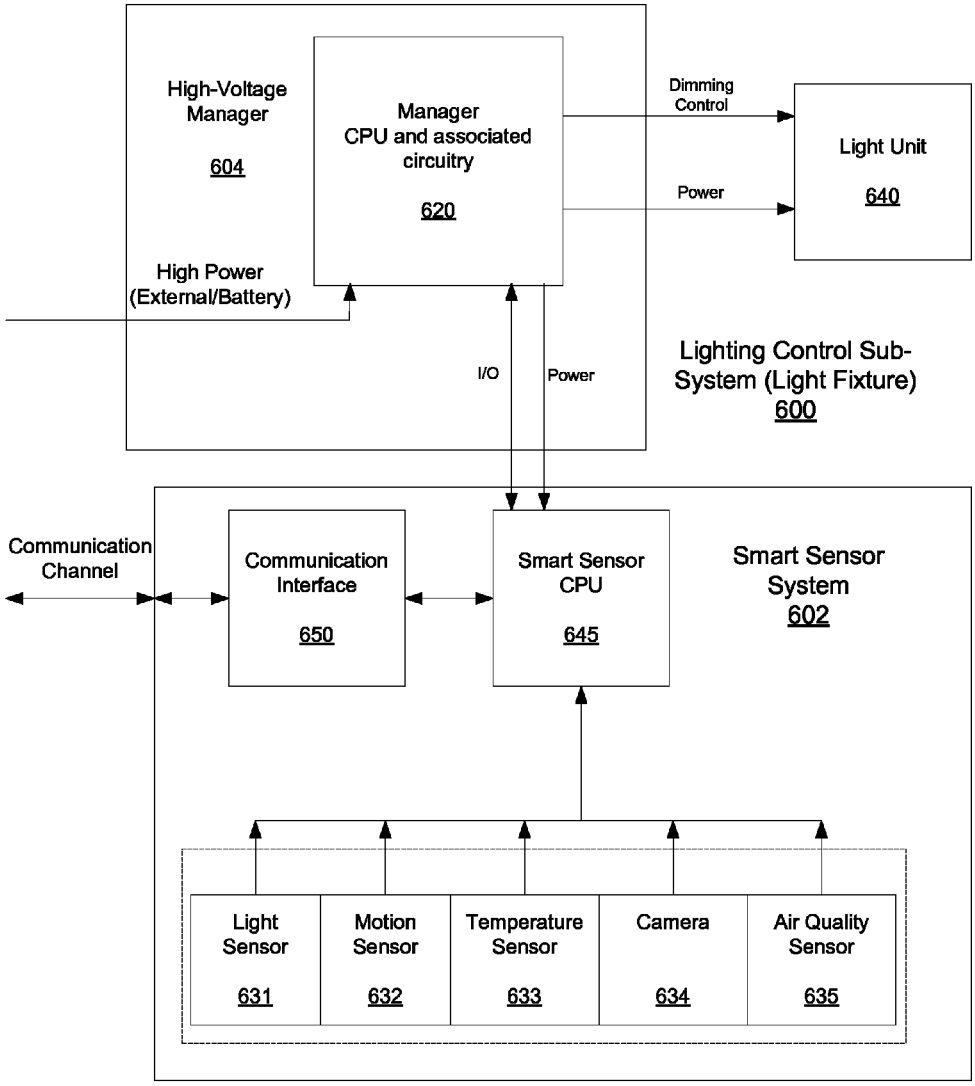
FIG. 6 shows an embodiment of an independently controllable light fixture, according to an embodiment.

FIG. 6 shows an embodiment of a light fixture 600 that can be utilized as the fixture of the described embodiments. This embodiment of the light fixture 600 includes a high-voltage manager 604 and a smart sensor system 602 that include a manager CPU 620 and smart sensor CPU 645 that operate in conjunction as a controller that independently manages and controls the operation of a lighting unit 640. The light fixture 600 can include any combination of sensors, such as, a light sensor 631, a motion sensor 632, a temperature sensor 633, a camera 634, and/or an air quality sensor 635. The light fixture 600 can receive profiles from elsewhere over a communications channel.

For the embodiment of FIG. 6, the high-voltage manager 604 receives a high voltage (for example, 120 Volts) and generates a power supply voltage for both the smart sensor system 602 (for example, 5 Volts) and the lighting unit 640, and a dimming control for the lighting unit 640. For this embodiment, both the high-voltage manager 604 and the smart sensor system 602 includes CPUs (central processing units) 620 and 645 which operate in conjunction to control the lighting unit 640. While shown as separate controllers, it is to be understood that the operations and functionality of the two CPUs could be included within a single controller.

The previously describe direct communication link can be established using any one or more of the sensors of the lighting fixture 600. The light sensor 631 and the motion sensor 632 are likely candidates, but the possibilities are open. For example, some embodiments of camera sensors can be utilized as motion sensor, which can be used to establish the direct link. A user device establishes the direct communication link with the lighting fixture 600, for example, by pulsing a light which is received or sensed by the light sensor 631. Alternatively, or additionally, the user device establishes the direct communication link with the lighting fixture 600 through motion that is sensed by the motion sensor 632.

As shown, the light fixture 600 includes the light unit 640. It is to be understood that the light unit 640 could alternatively be external to the controller. For this embodiment, the controller 6 (manager CPU 620 and smart sensor CPU 645) can include outputs to effect the light level changes. For example, the outputs can control relays to turn lights on and off, and control 0-10 V or PWM (pulse width modulation) outputs for dimming. The controller 620 can include a standard chipset that integrates a microprocessor unit, and interface for communicating different program instructions, and several ports for communicating with electronic devices.

The light fixture 600 additionally includes an interface 650 that allows the lighting fixture to communicate with the central controller through the second communications link. The interface 650 can be a wired (for example Ethernet®), or the interface can be wireless (for example, Zigbee®). The interface 650 can provide a direct link to the central controller, or the interface can provide an intermediate link to an intermediate device (such as the previously described gateway).

While the lighting fixture 600 provides lighting control, it is to be understood the equivalent fixtures for controlling other environmental parameters, such as, light, temperature, and humidity can additionally or alternatively be implemented according to the described embodiments. Accordingly, the control information can include at least one of light intensity, lighting scenes, thermostat, and/or a security alarm.

For embodiments, the second communication link comprises at least one of a cellular link to a service provider wherein the central controller is connected to the service provider, or an 802.11 wireless link between the user device and the central controller.

Figure 7:
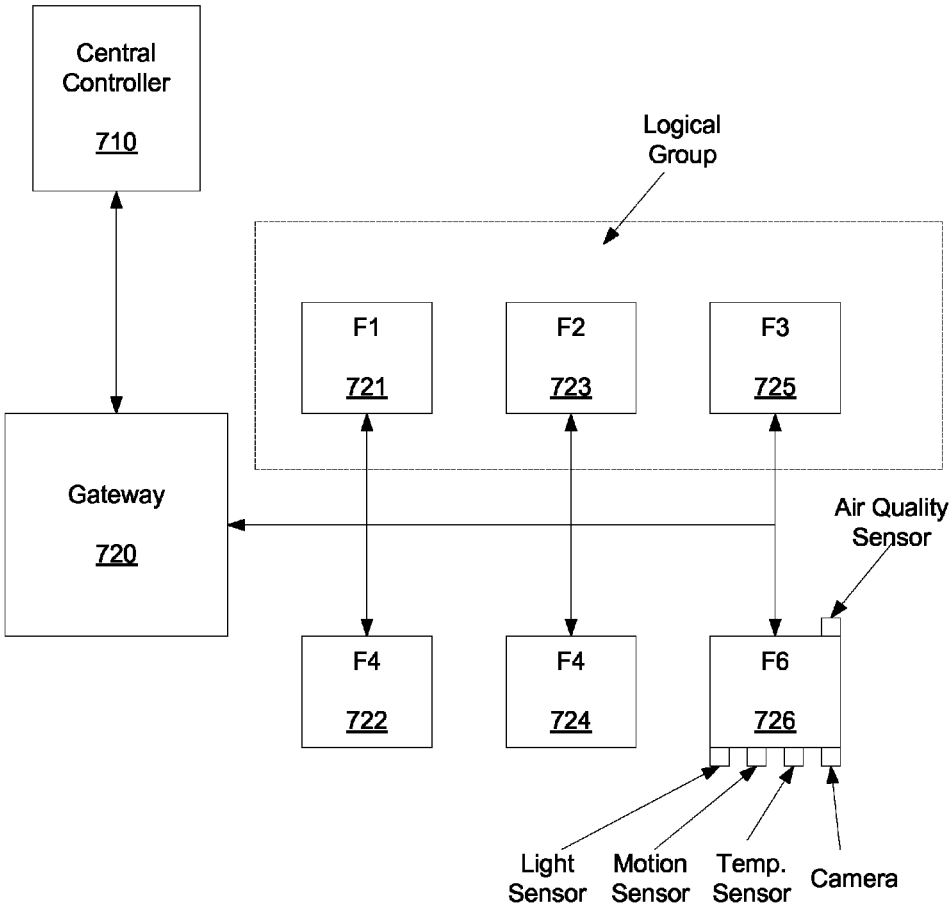
FIG. 7 shows an example of a plurality of independently controlled lights interfaced with a central controller.

FIG. 7 shows an example of a plurality of fixtures 722, 723, 724, 725, 726 that are interfaced with a central controller 710. For this embodiment, a gateway 720 is included within a communications path (second communication link) between the central controller 710 and the plurality of fixtures 722, 723, 724, 725, 726. The central controller 710 can initially provide each of the plurality of fixtures 722, 723, 724, 725, 726 with a light profile.

As shown, the independently controlled lights can include any number of sensors. The sensors can include, for example, a light sensor, a motion sensor, a temperature sensor, a camera, and/or an air quality sensor. Information obtained from the sensors can be used directly by the independently controlled light itself, or at least some of the information can be fed back to the central controller 710.

As shown, a plurality of the fixtures (such as, fixtures 721, 723, 725) can be included within a logical group. A user device can establish a direct communication link with any one of the fixtures. If the fixture is within a logical group, the user device can then control fixtures within the logical group by sending control information to the central controller 710 through the previously described second communications link. The controller can then control the fixtures of the logical group through communications through the first communications link.

Various embodiments include logical groups of fixtures that map onto, for example, a large conference room or a presentation hall. A user's direct communication link with any one of the fixtures within the conference room or presentation hall provides the user with access to a logical switch capable of controlling the entire space with preset scenes etc. That is, by accessing the logical switch through a direct link to any one of the fixtures of the logical group, the user can control the logical group. For an embodiment, the logical switch is configured by software operating on the fixtures and/or the central controller. The control of the logical switch offered to the user includes selection of an intensity of light of the logical group, and/or the selection of predetermined scenes associated with the logical group.

Another embodiment includes a method of providing user control of an environmental parameter of a structure. The method includes establishing a direct communication link between a user device and a fixture located within the structure, the fixture identifying itself by a first communication link to the user device, the user device using this identification to send control information to the fixture using the first communication link. This embodiment includes proximity based authorization.

Another embodiment includes method of providing user control of an environmental parameter of a structure. The method includes a user requesting control of one or more fixtures located within the structure, a central controller (backend server) receiving the user request (through a cellular or WiFi connection), accessing an electronic calendar (located at the central controller or remotely) to locate the fixture according to the electronic calendar, and providing the user with control information associated with the fixture, and the user selecting a control option for the fixture settings, and communicating selected control option back to selected fixture.

Although specific embodiments have been described and illustrated, the described embodiments are not to be limited to the specific forms or arrangements of parts so described and illustrated. The embodiments are limited only by the appended claims.

The invention claimed is:

1. A method of providing user control of an environmental parameter of a structure, comprising: establishing a direct communication link between a user device and a fixture located within the structure, wherein the direct communication link comprises a line-of-sight link; receiving, by a central controller, information of the user device from the fixture through a first communication link, wherein the central controller is physically separate from the fixture and the central controller communicates with the fixture through the first communication link; receiving, by the central controller, control information from the user device through a second communication link; associating, by the central controller, the user device with the fixture by correlating the receiving of information from the fixture through the first communication link with the receiving of the control information from the user device through the second communication link, and after associating the user device with the fixture, communicating, by the central controller, the control information to the fixture wherein the fixture controls the environmental parameter based on the control information.

2. The method of claim 1, wherein the correlation comprises a timing correlation.

3. The method of claim 1, wherein if the central controller correlates information received from more than one fixture with the user device, then the controller provides the user device with a selection.

4. The method of claim 1, wherein if the central controller correlates information received from more than one fixture with the user device, then the central controller communicates this to the user device, allowing the user device to re-establishing the direct communication link between the user device and the fixture located within the structure, whereby the central controller again receives of the information of the user device from the fixture through the first communication link, thereby uniquely associating the user device with the fixture.

5. The method of claim 1, wherein establishing the direct communication link comprises a sensor of the fixture receiving a stimulus directly from the user device.

6. The method of claim 5, wherein the sensor comprises an ambient light sensor.

7. The method of claim 5, wherein the sensor comprises a motion sensor.

8. The method of claim 6, wherein the stimulus comprises emitted light.

9. The method of claim 6, wherein the stimulus comprises information allowing identification of the user device that emitted the stimulus.

10. The method of claim 1, further comprising the user device completing a log-in procedure with the central controller.

11. The method of claim 1, wherein the fixture is a member of a logical group of fixtures, and the central controller provides control of a plurality of fixtures within the logical group as determined by the control information received from the user device.

12. The method of claim 1, wherein the fixture comprise a fixture controller and a light.

13. The method of claim 12, wherein the environmental parameter comprises at least one of light, temperature, humidity.

14. The method of claim 12, wherein the central controller communicates with the fixture controller through the first communication link.

15. The method of claim 14, wherein the first communication link comprises an Ethernet connection.

16. The method of claim 1, wherein the second communication link comprises at least one of a cellular link to a service provider wherein the central controller is connected to the service provider, or an 802.11 wireless link between the user device and the central controller.

17. The method of claim 1, wherein the control information comprises at least one of light intensity, lighting scenes, thermostat, security alarm.

18. A system that provides user control of lighting of a structure, comprising:

a lighting fixture operative to establish a direct communication link between a user device and the lighting fixture, wherein the lighting fixture is located within the structure, wherein the direct communication link comprises a line-of-sight link; a central controller operative to: receive information of the user device from the fixture through a first communication link, wherein the central controller is physically separate from the fixture and the central controller communicates with the fixture through the first communication link; receive control information from the user device through a second communication link; associate the user device with the fixture by correlating the receiving of information from the fixture through the first communication link with the receiving of the control information from the user device through the second communication link, and after associating the user device with the fixture, communicate the control information to the fixture, wherein the fixture controls the lighting based on the control information.

19. The system of claim 18, wherein if the central controller correlates information received from more than one fixture with the user device, then the central controller is operative to provide the user device with a selection.

20. The system of claim 18, wherein if the central controller correlates information received from more than one fixture with the user device, then the controller is operative to communicate this to the user device, allowing the user device to re- establish the direct communication link between the user device and the fixture located within the structure, whereby the central controller again receives information of the user device from the fixture through the first communication link.

21. The system of claim 18, wherein establishing the direct communication link comprises a sensor of the lighting fixture receiving a stimulus directly from the user device.

22. The system of claim 18, wherein the lighting fixture comprise a fixture controller and a light.

23. The system of claim 22, wherein the central controller communicates with the fixture controller through the first communication link.

24. The system of claim 18, further comprising a logical group of fixtures wherein the fixture is a member of the logical group, and the central controller provides control of a plurality of fixtures within the logical group as determined by the control information received from the user device.

25. An intelligent lighting fixture, comprising:

a light;

a sensor, the sensor operative to receive stimulus from a mobile device through a direct communication link;

a communication module, the communication module operative to:

communicate information of the user device to a central controller through a first communication link;

receive control information from the central controller through the first communication link, wherein the control information is received by the central controller from the user device through a second communication link;

associate the user device with the fixture by correlating the receiving of information from the fixture through the first communication link with the receiving of the control information from the user device through the second communication link, and after associating the user device with the fixture, control an intensity of the light based on the received control information.

* * * * *